United States Patent [19]

Kajikawa et al.

[11] Patent Number: 4,632,161

[45] Date of Patent: Dec. 30, 1986

[54] VENEER LATHE

[75] Inventors: Yoshimitsu Kajikawa; Keinosuke Souma; Kohei Ogaki; Tadashi Uzuka; Yoshihiko Minato, all of Hakodate, Japan

[73] Assignee: Uruko Seisakusho Co., Ltd., Japan

[21] Appl. No.: 692,693

[22] Filed: Jan. 18, 1985

Related U.S. Application Data

[62] Division of Ser. No. 430,500, Sep. 30, 1982, Pat. No. 4,494,590.

[30] Foreign Application Priority Data

Oct. 27, 1981 [JP] Japan ..... 56-171876

[51] Int. Cl.[4] ..... B27L 5/02

[52] U.S. Cl. ..... 144/213; 144/365

[58] Field of Search ..... 144/209 R, 212, 213, 144/365

[56] References Cited

U.S. PATENT DOCUMENTS 4,269,243 5/1981 Hasegawa ..... 144/213

4,494,589 1/1985 Kajikawa et al. ..... 144/213

*Primary Examiner*—W. D. Bray

*Attorney, Agent, or Firm*—Finnegan, Henderson, Farabow, Garrett & Dunner

[57] ABSTRACT

A veneer lathe for peeling a veneer from a log, comprising a knife mounted on a knife frame and adapted to peel said veneer from said log, a plurality of pressure bars retained on a pressure bar frame as disposed parallelly to said knife and spaced in the direction of the line of the blade of said knife, roller discs interposed one each between said plurality of pressure bars, retained on said pressure bar frame through the medium of rotary shafts, and rotated at a peripheral speed greater than the peripheral speed of said log, a guide face forming the passage of said veneer from the vicinity of said knife through said roller discs, a plurality of pressure rollers disposed on the lower side of said guide face and pressed displaceably in the direction of the axial line of said roller discs, and a guide member for said peeled veneer disposed on the underside of said pressure bar frame. Owing to the construction, the curl imparted to the freshly peeled veneer by the action of peeling is mended while the veneer is in the process of being carried off the knife of the veneer lathe.

8 Claims, 9 Drawing Figures

VENEER LATHE

This is a division of application Ser. No. 430,500, filed Sept. 30, 1982, now U.S. Pat. No. 4,494,590.

BACKGROUND OF THE INVENTION

1. Field of the Invention

This invention relates to a veneer lathe for peeling a wide, thin veneer from a log by a knife laid along the log by holding the log in position and rotating it about its axis by means of spindle chucks applied fast one each to the opposite end faces of the log and pressing the knife against the periphery of the log in rotation. More particularly, this invention relates to a veneer lathe which is capable of eliminating the phenomenon of curling, namely the inclination that the freshly veneer will turn upwardly owing to stress and other factors during the process of peeling, and which therefore is capable of increasing the yield of a high-quality veneer usable as face and back veneers in plywood which determines the commercial value of the finished plywood.

2. Description of the Prior Art

The veneer cut by and discharged from the conventional veneer lathe is liable to produce cracks on the rear side thereof and deviate upwardly from its predetermined course owing to the stress and other impacts generated during the process of peeling. The curl thus imparted to the veneer constitutes an obstacle to various works to be performed on the veneer subsequently to the work of peeling by the veneer lathe, making it difficult to materialize automation of a plywood production line or formation of a continuous flow of a plurality of production steps.

To mend the curl which persists in the freshly peeled veneer, there has prevailed a practice of installing immediately next to the veneer lathe an independent tenderizing machine provided with a rotary member having a multiplicity of sharp spikes implanted in the peripheral surface thereof and forcibly passing the freshly peeled veneer through the tenderizing machine.

As disclosed in U.S. Pat. No. 4,221,247 there has recently been developed a veneer lathe such that a veneer is peeled from a log by rotating, while in tight contact with the periphery of the log, discs each provided on the circumferential periphery thereof with a multiplicity of blades similar to the teeth of a saw thereby causing the blades on the discs to inflict stab wounds in the veneer and, at the same time, forcibly rotating the log against a knife advanced at a fixed rate toward the axis of the log, and the curl persisting in the veneer just peeled by and discharged from the knife is mended by bending the veneer below a pressure bar frame thereby forcibly producing cracks in the front side of the veneer to counterbalance the cracks first sustained in the rear side.

When the veneer lathe is provided with a tenderizing device or discs incorporating saw-toothed blades, however, the produced veneer inevitably sustains numerous stab wounds. When the veneer is peeled from a brittle log or the veneer is produced in a very small thickness of less than 1 mm, for example, such stab wounds may possibly develop into tears while the freshly peeled veneer is in transit. The veneer sustaining such tears cannot be used in the outermost plies in a plywood which determine the commercial value of the produced plywood. Even when it is used in the inner plies of a plywood, the plywood is obtained in low yield.

Further when the tenderizing device is installed immediately next to the veneer lathe, the addition of this device fairly increases the overall size of the veneer production equipment and the veneer production cost as well.

SUMMARY OF THE INVENTION

It is an object of this invention, therefore, is to provide a veneer lathe which enables the curl imparted to the veneer during the process of peeling to be mended at the time that the veneer is departing from the cutter of the veneer lathe to produce a veneer capable of easy handling.

Another object of this invention is to provide a veneer lathe capable of producing in high yield a high-quality veneer containing no stab wound from a low-grade log containing cracks, decays, or other defects.

The other objects of this invention will become apparent from the further disclosure of this invention to be made herein below.

BRIEF DESCRIPTION OF THE DRAWINGS

The objects and advantages of the present invention will appear more fully from the detailed description of the invention to be given herein below with reference to the accompanying drawings, in which:

FIG. 3 is a schematic diagram illustrating the front view of the essential part of FIG. 1.

DETAILED DESCRIPTION OF THE INVENTION

Now, the present invention will be described in detail below with reference to preferred embodiments illustrated in the accompanying drawings.

Figure 1:
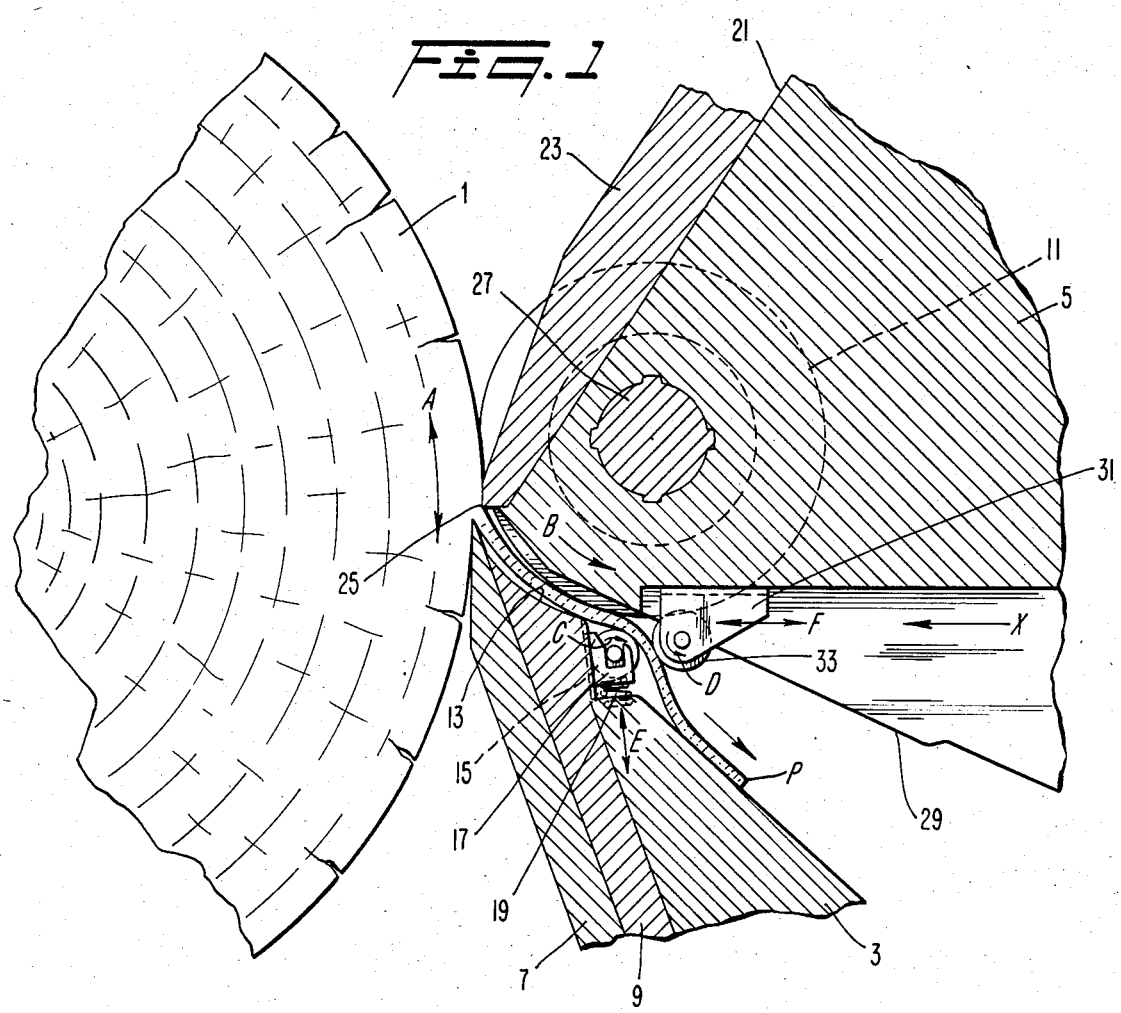
FIG. 1 is a cross section illustrating an essential part of one preferred embodiment of this invention.

In FIG. 1, a log 1 is held in position with spindle chucks (not shown) which nip the log 1 by the opposite end faces and the log 1 is rotated in the direction of the arrow A. A knife frame 3 and a pressure bar frame 5 are paired in the vertical direction, held in position by being nipped at the opposite faces, and adapted so as to be quickly moved toward or away from the log 1 by means of feed screws (not shown). The knife frame 3 and the pressure bar frame 5 are also interlocked with an inching device (not shown) which advances the knife frame 3 and the pressure bar frame 5 toward the log 1 (in the direction of the arrow X) by a distance of the prescribed thickness of the veneer being peeled for each complete rotation of the log 1.

The knife frame 3 has a substantially triangular cross section. A knife 7 is held fast such as with a hydraulic clamp (not shown) with the cutting edge thereof pointing upwardly at a prescribed position on the side of the knife frame 3 opposed to the log 1, with the line of the cutting edge running parallel to the axial line of the log 1. The knife frame 3 is provided on the side thereof adjoining the knife 7 with a cap 9 made of stainless steel, for example. The upper leading end of the cap 9 forms a substantially triangular cross section. Between the position slightly backward in the direction of veneer discharge from the cutting edge of the knife 7 and the outer periphery of a roller disc 11 which will be more fully described afterward, there is formed an arcuate or slanted veneer guide face 13. A pressure roller 15 is disposed at the top of the knife frame 3 on the lower side of the guide face 13 relative to the direction of veneer discharge.

The pressure roller 15 is formed in a small width and rotatably pivoted on a bracket 17 by means of a miniature bearing. The bracket 17 is formed on the lower rear side of the guide face 13 of the aforementioned cap 9 and set in position in a groove. The pressure roller 15 is further retained resiliently with a spring 19 interposed between the pressure roller 15 and the top of the knife frame 3, so as to be freely displaced in the direction of the axis of rotation of the aforementioned roller disc 11. Thus, it serves to keep the pressure roller 15 resiliently in contact with the periphery of the roller disc 11 and allow it to be rotated by frictional contact with the veneer in the direction of the arrow C.

Figure 2:
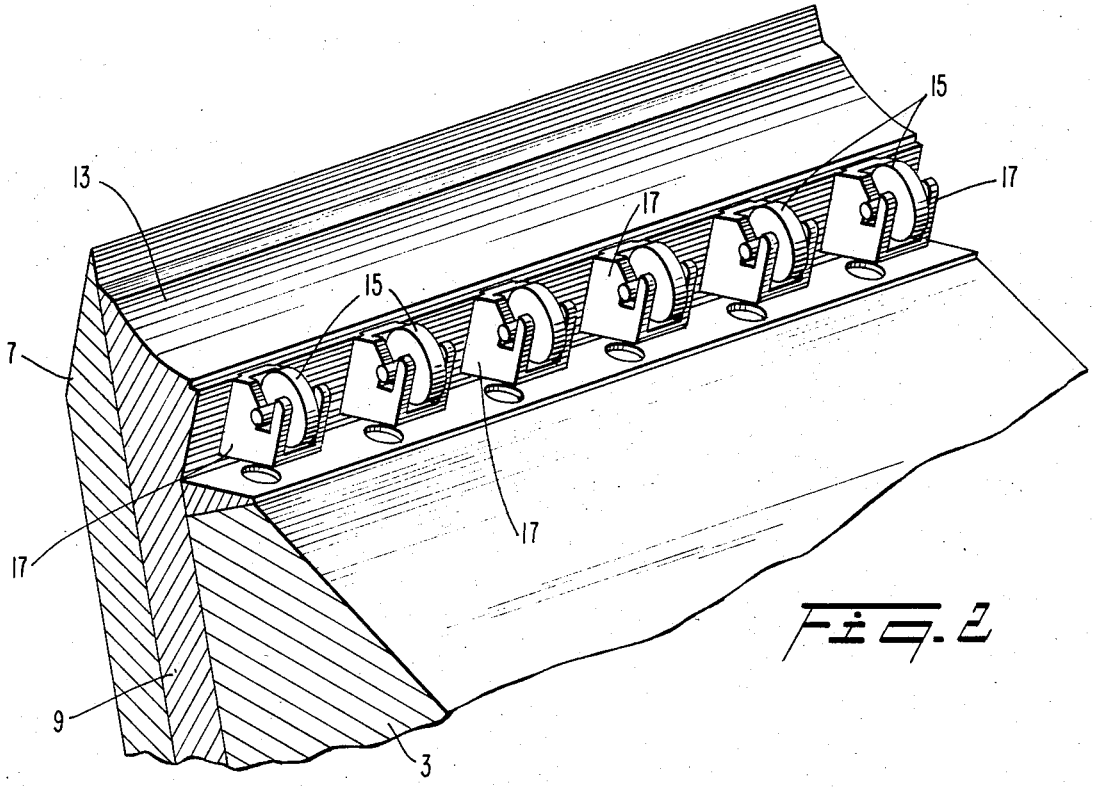
FIG. 2 is a perspective view of the essential part of FIG. 1.

A plurality of such pressure rollers 15 fitted to the bracket 17 are coaxially disposed parallel to the line of cutting edge of the knife 7 throughout the entire width (in the longitudinal direction of the log 1) of the knife frame 3 as illustrated in FIG. 2. They are disposed coincidentally with the roller disc 11 as illustrated in FIG. 3. Part of these pressure rollers 15 may be omitted suitably in the middle portion or in the opposite end portions, depending on the kind of log 1 or the width of the veneer P being peeled. As means for applying pressure to the pressure rollers 15, there may be used a hydraulic cylinder in the place of the aforementioned spring 19. Optionally, the spring 19 or the hydraulic cylinder may be built inside the bracket 17. The pressure rollers 15 may be coated with elastic members made of rubber, for example so as to acquire an ability to absorb pressure and permit omission of the aforementioned pressure means. The elastic members will serve to add to the contact friction between the pressure rollers 15 and the veneer P.

Figure 4:
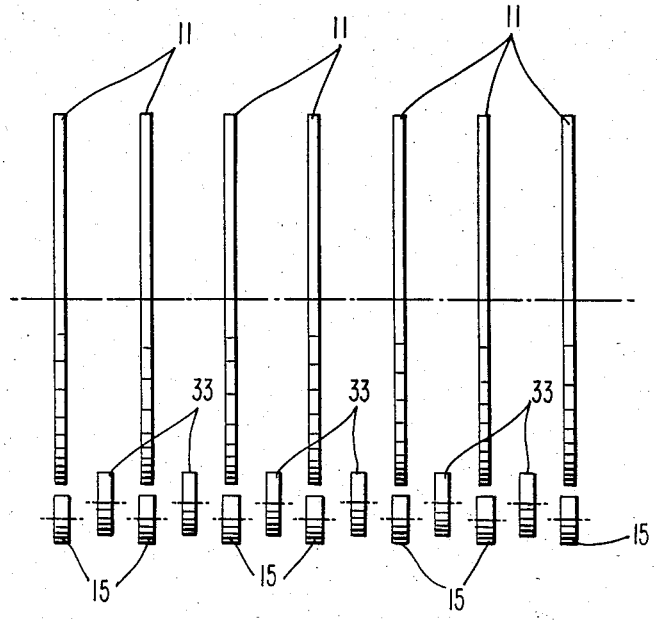
FIG. 4 is a perspective view of the essential part.

Above the knife frame 3, the pressure bar frame 5 is mounted. As already described, this pressure bar frame 5 and the knife frame 3 are both nipped integrally at their opposite end faces so that they may be moved toward and away from the log 1. The side of the pressure bar frame 5 opposed to the log 1 forms an inclined face 21. On this inclined face 21, a plurality of inclined pressure bars 23 of a small width capable of pressing the periphery of the log 1 are arrayed as spaced by small intervals as illustrated in FIG. 4. These pressure bars 23 are disposed with their lower ends running parallel to the axial line of the log 1 so as to serve as pressing parts 25 for the log 1.

Optionally, all or a plurality of these inclined pressure bars 23 may be formed integrally in one piece, with suitable cuts inserted at the portions corresponding to those gaps interposed between such inclined pressure bars 23.

Nearly in the middle of the inclined face 21 of the pressure bar frame 5, there is disposed a height adjusting mechanism (not shown). Adjusting screws are inserted into this adjusting mechanism and are connected at the lower leading ends thereof to the pressure bars 23. Thus, the adjusting mechanism permits desired adjustment of the positions at which the lower ends of the pressure bars 23 exert pressure to the log 1.

The application of pressure to the log 1 by these pressure bars 23 is intended to preclude occurrence of chipping in the peeled veneer during the process of peeling of a veneer from the log, regulate the thickness of the veeneer correctly, and provide effective smoothening of the peeled skin of the veneer. The portion for producing a peeled veneer which is formed by the leading ends of the pressure bars 23 and the cutting edge of the knife 7 is called a lip.

On the pressure bar frame 5, a rotary shaft 27 is pivotally mounted parallel to the line of the cutting edge of the knife 7 in the neighborhood of the aforementioned lip. On this rotary shaft 27 are pivotally mounted, either directly or through the medium of fitting flanges, a plurality of spaced thin roller discs 11 having a smooth circumferential periphery. The roller discs 11 are disposed one each in the gaps separating the pressure bars 23 as illustrated in FIG. 4. In the case of one whole pressure bar containing a plurality of spaced cuts, these roller discs 11 are disposed in the cuts. The roller discs 11 are evenly distributed throughout the entire width of the pressure bar frame 5 (in the direction of the length of the log 1). At the same time, they are pivotally supported at positions such that they may come into forced contact with the periphery of the log 1 slightly upward from the pressing parts 25 of the pressure bars 23 and also come into contact with the upper face of the veneer P freshly peeled from the log 1.

Generally the rotary shaft 27 is formed in the shape of a splined shaft, provided with a tension device operated by a variable-speed motor (not shown) secured above the pressure bar frame 5, for example, through the medium of a chain or some other endless conveyance mechanism (not shown), and kept in constant rotation in the direction of the arrow B at a peripheral speed greater than the peripheral speed of the log 1.

The roller discs 11 are desired to be driven at a peripheral speed greater by 2 to 20% than the peripheral speed of the log 1.

On the underside 29 of the pressure bar frame 5, a guide member such as a plurality of guide rollers 33 of a small width pivotally supported in brackets 31 with the aid of miniature bearings, for example, is disposed as illustrated in FIG. 4. These guide rollers 33 are coaxially disposed parallel to the line of cutting edge of the knife 7. The brackets 31 which pivotally support the guide rollers 33 in position are attached to the underside 29 of the pressure bar frame 5 in such a manner that they may be freely moved toward or away from the pressure rollers 15 (in the direction of the arrow F). The guide rollers 33 have a surface which remains in contact with the upper face of the veneer P, that is freshly peeled and moved away from the knife as the guide rollers 33 and rotate by frictional contact with the veneer in the direction of the arrow D.

The opposed circumferential peripheries of the aforementioned pressure rollers 15 and the guide rollers 33 form a passage for the veneer P. The space separating the opposed peripheries generally is slightly greater than the thickness of the veneer P. As occasion demands, it may be several times greater than the thickness of the veneer P. Further, the guide rollers 33 in the direction of height are disposed so that the points at which the guide rollers 33 come into contact with the rear face of the veneer P fall below the points at which the pressure rollers 15 come into contact with the rear face of the veneer P. Optionally, the guide rollers 33 may be substituted by either one whole shaft having no roller thereon and extending throughout the entire length of the pressure bar frame 5 or a plurality of shafts separated in the direction of the width of the pressure bar frame 5. The periphery of this shaft is naturally expected to fulfil the same function as the peripheries of the guide rollers 33.

The guide rollers 33 are generally disposed as separated from the pressure rollers 15 in the direction of the width of the pressure bar frame 5 (in the direction of the axial line of the log 1). They are, however, disposed in the same positions as the pressure rollers 15 when the pressure rollers 15 are disposed so as to deviate from the roller discs 11.

As in the case of the pressure rollers 15, some of the guide rollers 33 in the middle part or in the opposite end parts relative to the direction of the width of the pressure bar frame 5 may be suitably omitted, depending on the kind of log, the width of the veneer to be peeled, etc.

Now, preferred embodiments, operation, and effects of the present invention constructed as indicated above will be described in detail below.

The log 1 is nipped at the opposite end faces thereof by a spindle chuck and is rotated in the direction of the arrow A as illustrated in FIG. 1. The knife frame 3 and the pressure bar frame 5 together advance toward the log 1. The plurality of roller discs 11 have smooth circumferential peripheries and are driven at a peripheral speed greater than the peripheral speed of the log 1. They are held in constant contact with the log 1 with suitable pressure. By the cooperation of the pressure bars 23 and the knife 7, a veneer P is peeled from the log 1 and moved away from the knife.

During the process of this peeling, the pressures exerted an effect of pressing the log 1 in a diagonally downward direction. Consequently, this resultant force manifests a notable effect in precluding not only the flexure which the log 1 inevitably produces in the direction opposite the direction of veneer peeling while the veneer lathe is peeling a veneer from the log 1 but also the so-called bending, a phenomenon in which the central part in the axial direction of the log 1 is separated from the knife 7 while the log 1 nipped at the opposite end faces thereof by the spindle is rotated about its axis. Generally during the process of peeling the veneer from the log 1 by the operation of the veneer lathe, the knife 7 is liable to bite into the log 1, with the result that the log 1 will be pushed away toward the pressure bars 23 and, consequently, the frictional resistance of the pressure bars 23 will be increased. In the veneer lathe of the present invention, however, since the plurality of pressure bars 23 rotate the log 1 as they are held in forced contact with the periphery of the log 1 at a position slightly upward in the direction of the rotation of the log 1 from the position at which the pressure bars 23 exert their pressure upon the log 1, the aforementioned possible increase of the resistance of the pressure bars 23 is successfully precluded.

Figure 5:
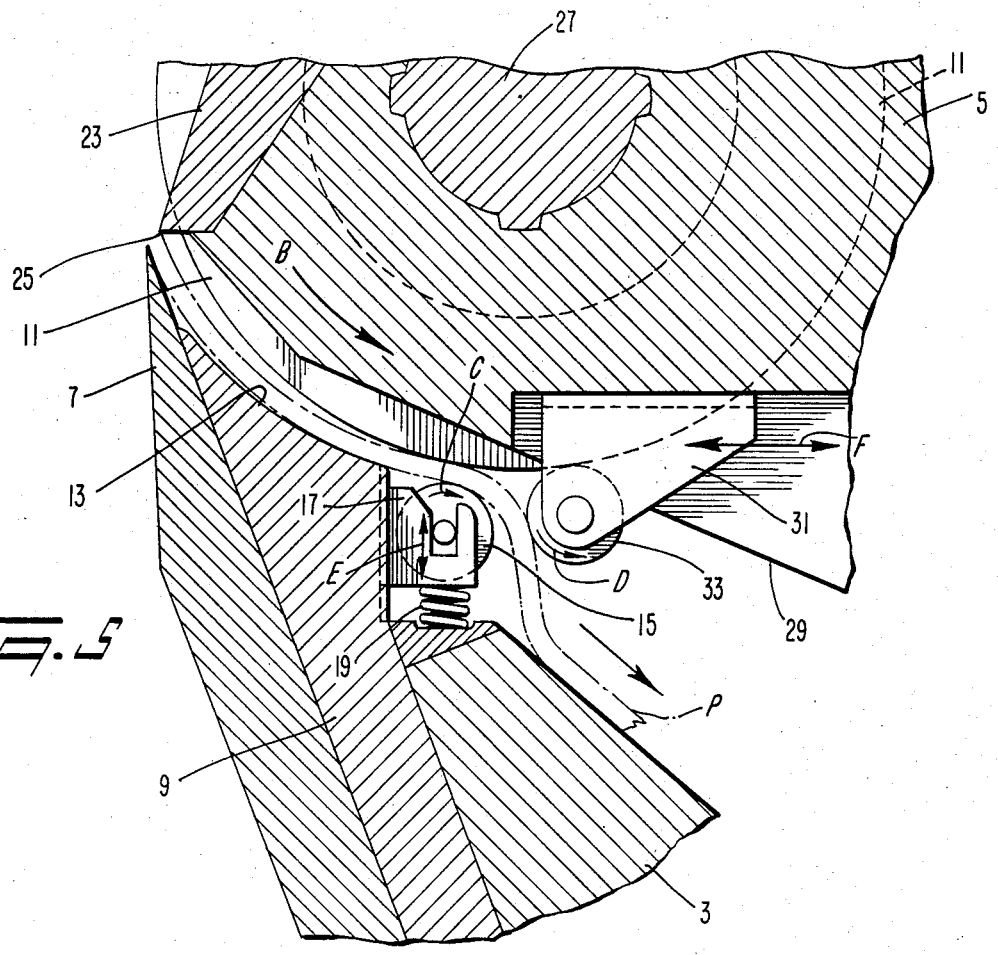
FIG. 5 is a partially enlarged view illustrating an essential part of FIG. 1.
Figure 4:
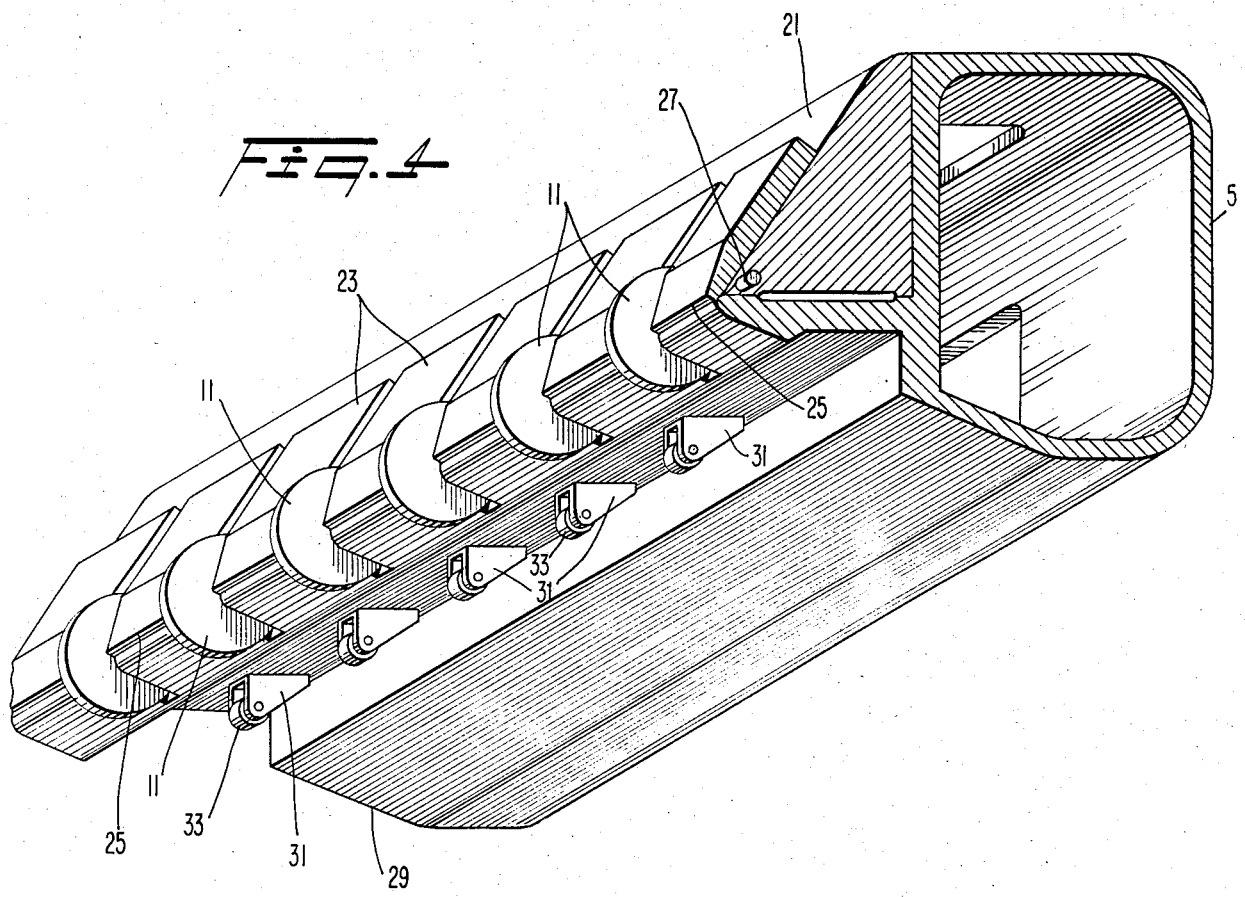

The roller discs 11, under moderate pressure and with an ability to absorb shocks, remain in forced contact with the pheriphery of the log 1 slightly upward in the direction of the rotation of the log 1 from the point at which the pressure bars 23 exert their pressure on the periphery of the log 1. And they are driven at a peripheral speed greater than the peripheral speed of the log 1. Thus, the roller discs 11 in effect function to push the peeled veneer P from the lip toward the guide face 13 and enable the knife to peel the veneer without failure. The peeled veneer P is never allowed to clog the lip. By the roller discs 11, the veneer P is forwarded smoothly on the guide face 13 of the cap 9 as illustrated in FIG. 5. The veneer P which has passed the guide face 13 of the cap 9 and reached the pressure rollers 15 pushes the pressure rollers 15 downwardly by overcoming the pressure exerted by the pressure rollers 15 upon the roller discs 11. It is then forwarded as pressed down by the roller discs 11 toward the downstream side. At this time, since the roller discs 11 are driven at a peripheral speed greater by 2 to 20% than the peripheral speed of the log 1, the peeled veneer P emerging between the leading end of the knife 7 and the pressure rollers 15 is drawn by the pressure rollers 15 and the roller discs 11 now functioning similarly to pinch rollers. Consequently, the veneer P is stretched in the direction of conveyance and is given a preliminary tenderizing treatment. Further by the guide rollers 33, the veneer P is forcibly bent in a direction opposite the direction of the curl in the veneer with the pressure rollers 15 as the fulcrum. During the forced bending, countless cracks are produced on the front side of the veneer. The peeled veneer P, therefore, is given a thorough tenderizing treatment while in transit and forwarded in the shape of a flat sheet free from curl. The veneer discharged from the veneer lathe is free from stab wounds. Thus, the veneer lathe of this invention produces a smooth high-quality veneer.

Figure 6:
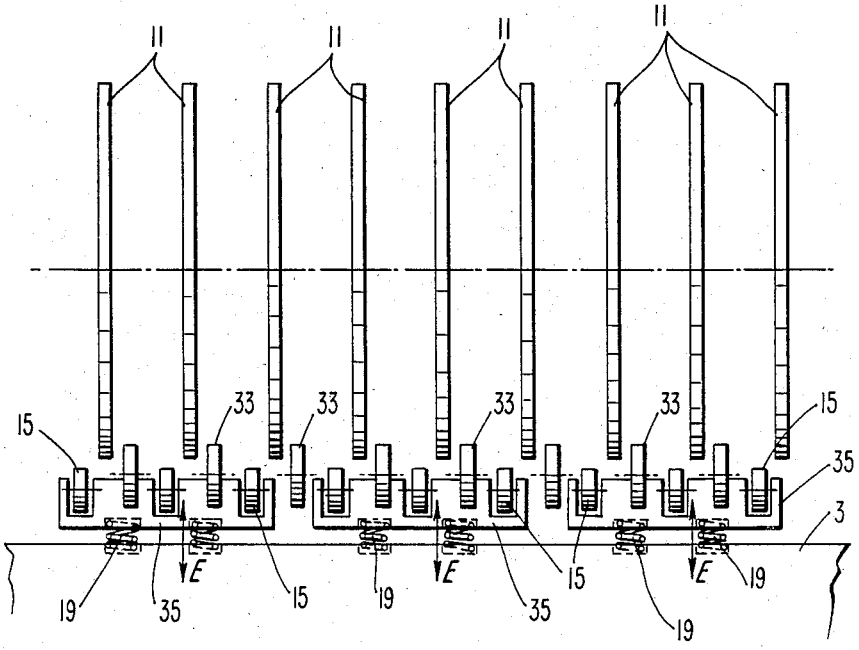
FIG. 6 is a schematic diagram of the front view illustrating yet another preferred embodiment of this invention.

FIG. 6 represents another preferred embodiment of the veneer lathe of this invention. In this diagram, the pressure rollers 15 are disposed so as not to come into contact with the circumferential peripheries of the roller discs 11. The plurality of pressure rollers 15 are divided into a few sets each of three pieces, for example. The individual pressure rollers 15 in each set are pivotally supported in one and the same bracket 35. The brackets 35 are disposed so that all the pressure rollers 15 share one common axis.

Figure 7:
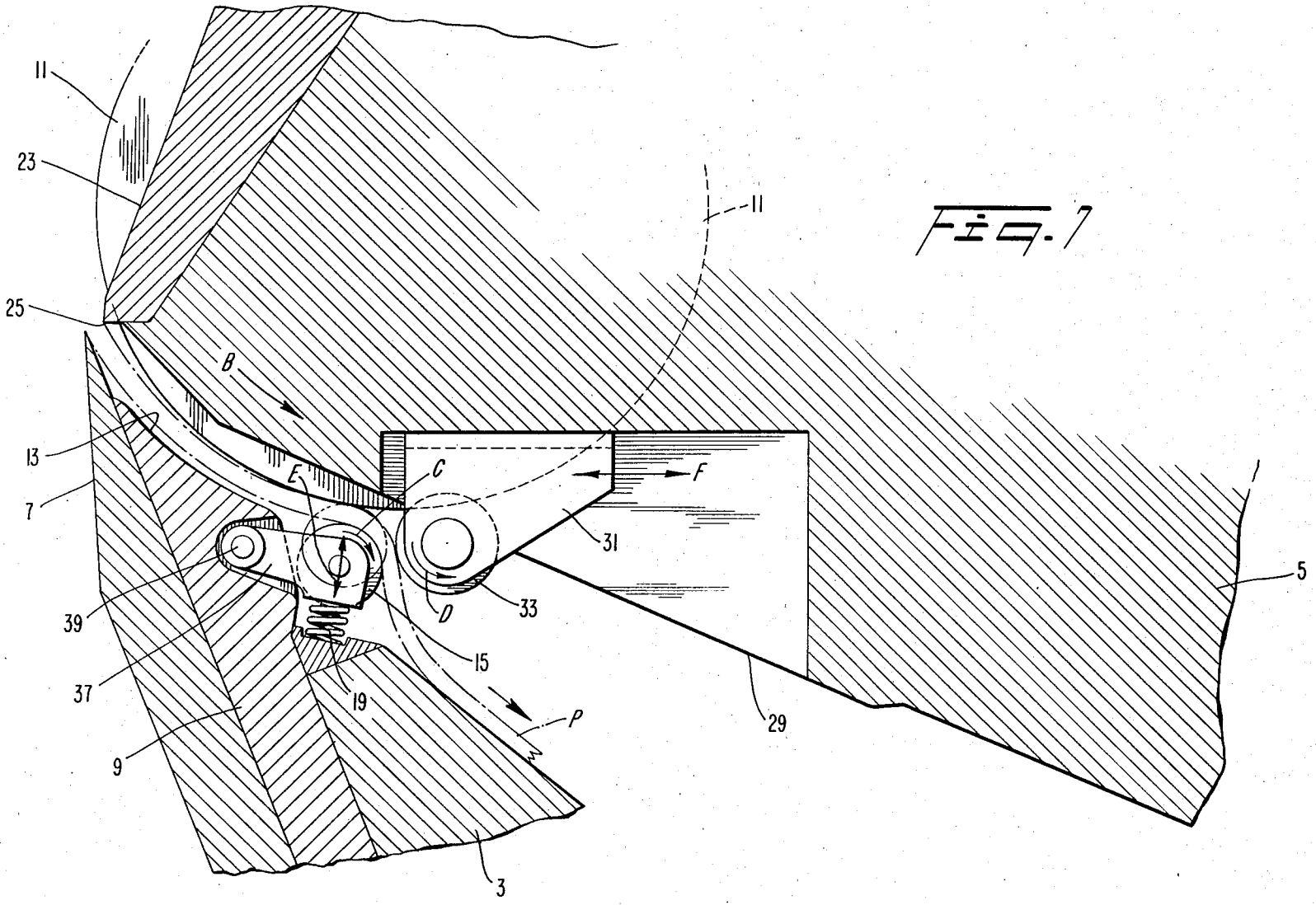
FIGS. 7–9 are side views illustrating essential parts in other preferred embodiments of the invention.

FIG. 7 represents yet another preferred embodiment of this invention. In the diagram, a bracket arm 37 is swingably supported through the medium of a supporting shaft 39 above the cap 9. The pressure rollers 15 are rotatably supported on this bracket arm 37. Springs 19 are interposed as pressure means between the lower side of the bracket arm 37 and the top of the knife frame 3.

In each of the preferred embodiments described above, the pressure rollers 15 are attached to the knife frame 3 because the peeled veneer P is conveyed through the space intervening between the underside of the pressure bar frame 5 and the upper side of the knife frame 3. Optionally, the pressure rollers 15 may be designed so as to be suspended such as with an arm bracket (not shown) from the vicinities of the opposite ends of the pressure bar frame 5.

Figure 8:
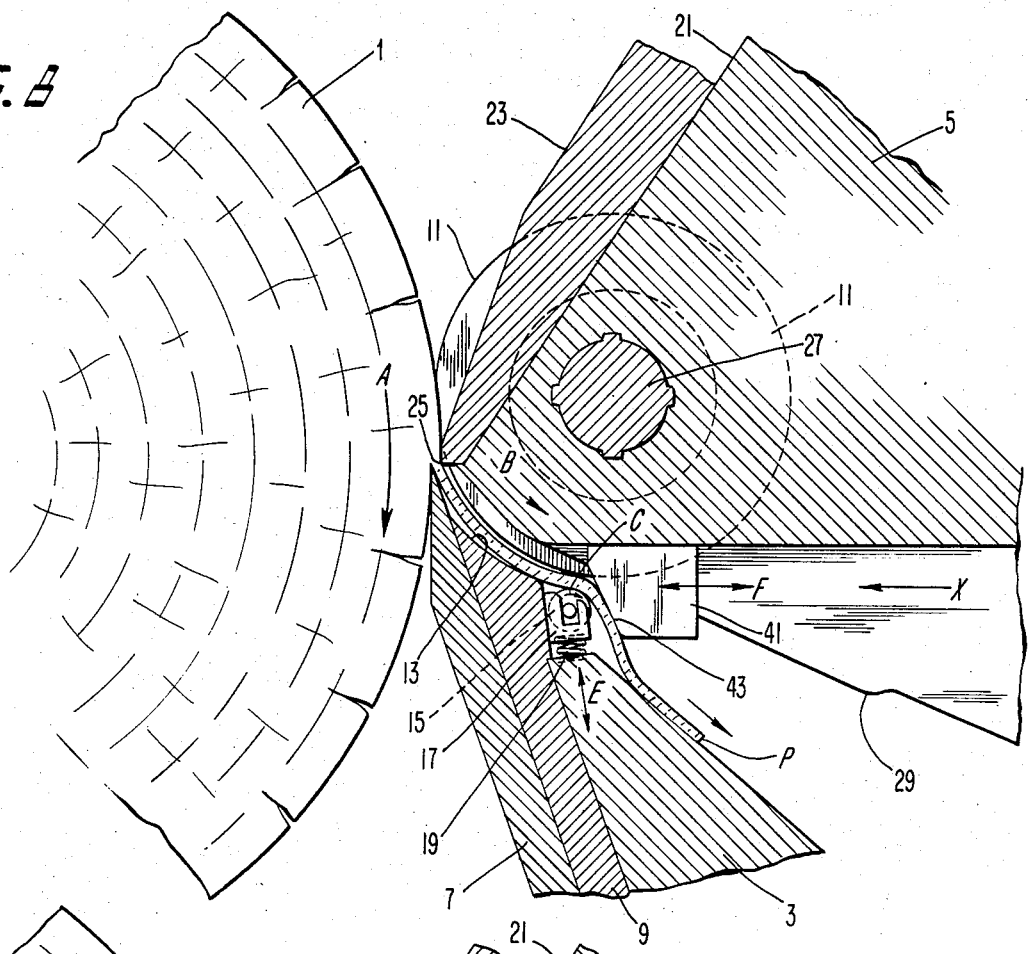

FIG. 8 represents a further preferred embodiment of this invention. This veneer lathe differs from the veneer lathe of FIG. 1 in that guide tips 41 are disposed in the place of guide rollers 33. These guide tips 41 are possessed of veneer guide faces 43 opposed to the aforementioned pressure rollers 15. They are secured to the underside 29 of the pressure bar frame 5 or attached thereto in such a manner that they may be moved toward or away from the pressure rollers 15. The space intervening between the peripheries of the pressure rollers 15 and the aforementioned guide faces 43 opposed thereto is slightly greater than the thickness of the peeled veneer P. Optionally, this space may be greater by 2 to 3 times than the thickness of the veneer.

The degree of the inclination of the guide faces 43 is greater than that of the underside 29 of the pressure bar frame 5. Preferably for the purpose of detracting from the frictional resistance exerted upon the veneer in conveyance, the guide tipes 41 may be designed so that their thickness (in the direction of the width of the pressure bar frame 5) will gradually decrease toward the aforementioned guide faces 43. For example, the guide tips 41 may be so shaped that their cross sections will be converged toward the pressure rollers 15 and the vertexes form the guide faces 43.

Figure 9:
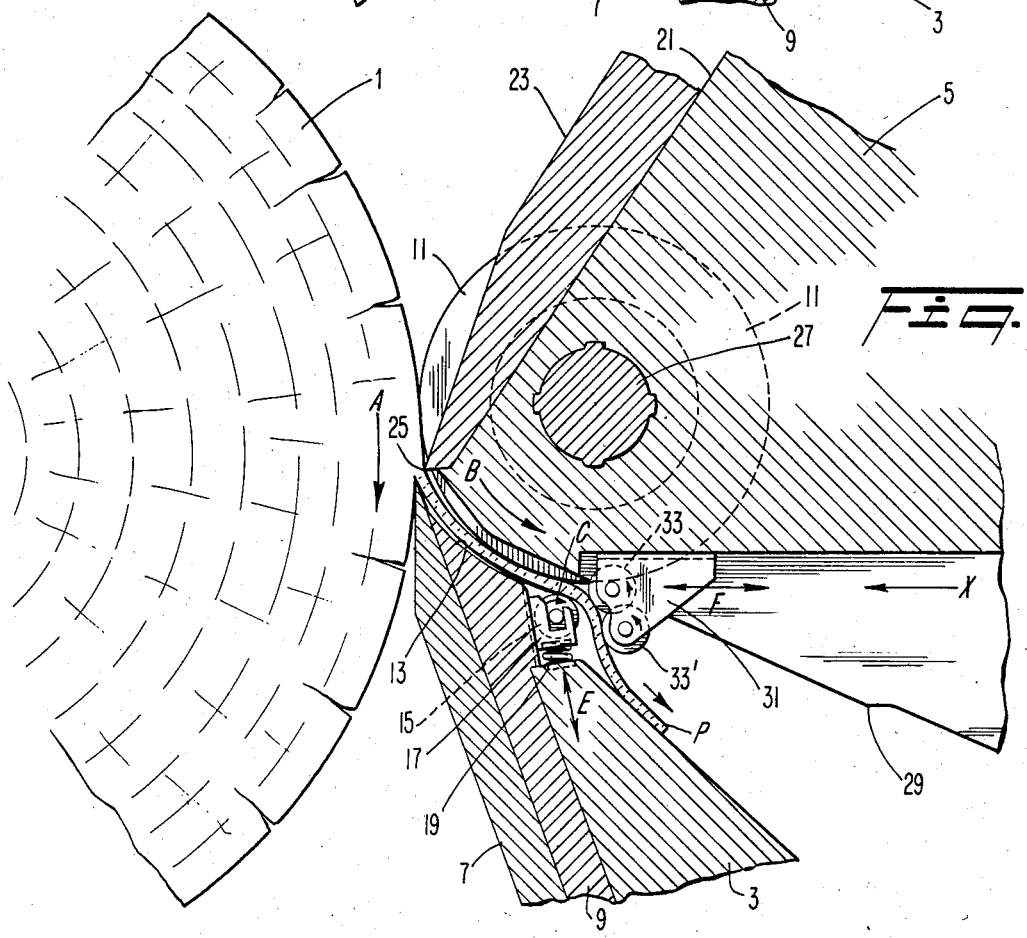

FIG. 9 represents still another preferred embodiment of the veneer lathe of this invention. In the diagram, a plurality, two for example, of guide rollers 33, 33' are pivotally supported rotatably in the direction of the conveyance of veneer on the bracket 31 attached to the underside 29 of the pressure bar frame 5. The plurality of guide rollers 33, 33' serve to impart a forcible downward bend to the veneer P which is held down on the roller discs 11 by the pressure rollers 15. The downward bend enables the veneer P to sustain cracks without fail on its face side. The extent of tenderizing on the veneer P can be regulated by proper adjustment of the positions of the guide roller 33' on the discharge side.

The preferred embodiments described above are to illustrate the most desirable manners in which the present invention can be worked. They can be altered or modified in various ways without departing from the spirit of this invention.

What is claimed is:

1. A veneer lathe for peeling veneer from a log, said veneer comprising:

a knife mounted on a knife frame;

a pressure bar frame;

a plurality of spaced pressure bars retained on said pressure bar frame for applying pressure to said log, each said plurality of spaced pressure bars having a portion proximate said knife, the portions of said pressure bars nearest said knife being aligned substantially parallel thereto, thereby forming a gap between said knife and said pressure bars, said gap defining the thickness of said veneer;

a plurality of roller discs individually rotatably mounted along a common axis in the spaces between successive ones of said pressure bars;

means for rotating said roller dics at a peripheral speed greater than the peripheral speed of said log;

a guide face mounted on said knife frame adjacent said knife and havng a shape substantially corresponding to the periphery of said roller dics, thereby forming a curved path for said veneer peeled from said log;

a plurality of parallel-mounted, pressure rollers consecutively spaced along said knife frame adjacent said guide face, each of said plurality of pressure rollers being axially spaced from said roller discs, said pressure rollers continuing said path provided by said guide face and exerting forces on said veneer in a direction perpendicular to said axis of said roller discs; and a plurality of parallel-mounted guide members mounted on said pressure bar frame and disposed along the path of said veneer after said pressure rollers, said guide members having a guide surface to exert a force on said veneer in a direction substantially perpendicular to the direction of force of said pressure rollers.

2. A veneer lathe according to claim 1, wherein said roller discs are driven at a peripheral speed greater by 2 to 20% than the peripheral speed of said log.

3. A veneer lathe according to claim 2, wherein said pressure rollers are spring-biased.

4. A veneer lathe according to claim 2, wherein said pressure rollers are biased by hydraulic cylinders.

5. A veneer lathe according to claim 2, wherein said pressure rollers have the circumferential peripheries thereof coated with an elastic member.

6. A veneer lathe according to claim 2, wherein said guide members are integrally formed with said pressure bar frame.

7. A veneer lather according to any one of claims 3–6 wherein said guide members comprise a plurality of guide rollers.

8. A veneer lathe according to any one of claims 3–6, wherein said guide members comprises guide tips having a guide face for the passage of said veneer.

* * * * *